US009799323B2

(12) United States Patent
Conkie et al.

(10) Patent No.: US 9,799,323 B2
(45) **Date of Patent: *Oct. 24, 2017**

(54) SYSTEM AND METHOD FOR LOW-LATENCY WEB-BASED TEXT-TO-SPEECH WITHOUT PLUGINS

(71) Applicant: Nuance Communications, Inc., Burlington, MA (US)

(72) Inventors: Alistair D. Conkie, San Jose, CA (US); Mark Charles Beutnagel, Mendham, NJ (US); Taniya Mishra, New York, NY (US)

(73) Assignee: Nuance Communications, Inc., Burlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/967,740

(22) Filed: Dec. 14, 2015

(65) Prior Publication Data

US 2016/0098985 A1 Apr. 7, 2016

Related U.S. Application Data

(63) Continuation of application No. 13/308,860, filed on Dec. 1, 2011, now Pat. No. 9,240,180.

(51) Int. Cl.

| | |
|---|---|
| ***G10L 13/00*** | (2006.01) |
| ***G10L 13/08*** | (2013.01) |
| ***G10L 13/04*** | (2013.01) |
| ***G10L 13/10*** | (2013.01) |

(52) U.S. Cl.
CPC ..... *G10L 13/04* (2013.01); *G10L 13/10* (2013.01)

(58) Field of Classification Search
USPC ..... 704/258, 260
See application file for complete search history.

(56) References Cited

U.S. PATENT DOCUMENTS

| | | | |
|---|---|---|---|
| 4,692,941 | A | 9/1987 | Jacks et al. |
| 4,852,168 | A | 7/1989 | Sprague |
| 5,850,629 | A | 12/1998 | Holm et al. |

(Continued)

FOREIGN PATENT DOCUMENTS

| | | |
|---|---|---|
| WO | WO 2007/007215 | 1/2007 |

OTHER PUBLICATIONS

Aylett et al "Scalable Mobile Implementation of High Quality Real Time Text to Speech Synthesis", Sep. 2010, in MobileHCI 2010, pp. 1-4.*

(Continued)

*Primary Examiner* — Olujimi Adesanya

(57) ABSTRACT

Disclosed herein are systems, methods, and non-transitory computer-readable storage media for reducing latency in web-browsing TTS systems without the use of a plug-in or Flash® module. A system configured according to the disclosed methods allows the browser to send prosodically meaningful sections of text to a web server. A TTS server then converts intonational phrases of the text into audio and responds to the browser with the audio file. The system saves the audio file in a cache, with the file indexed by a unique identifier. As the system continues converting text into speech, when identical text appears the system uses the cached audio corresponding to the identical text without the need for re-synthesis via the TTS server.

20 Claims, 4 Drawing Sheets

(56) References Cited

U.S. PATENT DOCUMENTS

| | | | | |
|---|---|---|---|---|
| 5,983,190 | A | 11/1999 | Trower et al. | |
| 6,081,780 | A | 6/2000 | Lumelsky | |
| 6,246,672 | B1 | 6/2001 | Lumelsky | |
| 6,260,011 | B1 | 7/2001 | Heckerman et al. | |
| 6,510,413 | B1 | 1/2003 | Walker | |
| 6,546,366 | B1 * | 4/2003 | Ronca | G10L 13/04 704/258 |
| 6,810,379 | B1 | 10/2004 | Vermeulen et al. | |
| 7,027,568 | B1 | 4/2006 | Simpson et al. | |
| 7,035,803 | B1 | 4/2006 | Ostermann et al. | |
| 7,174,295 | B1 * | 2/2007 | Kivimaki | G09B 19/04 704/260 |
| 7,454,346 | B1 * | 11/2008 | Dodrill | G10L 13/047 704/258 |
| 7,500,193 | B2 | 3/2009 | Spielberg et al. | |
| 7,627,478 | B2 | 12/2009 | Cosatto et al. | |
| 8,224,647 | B2 | 7/2012 | Niemeyer | |
| 8,321,225 | B1 | 11/2012 | Jansche et al. | |
| 8,959,021 | B2 * | 2/2015 | Kaszczuk | G10L 13/02 704/258 |
| 2002/0095552 | A1 | 7/2002 | Kavipurapu | |
| 2002/0103646 | A1 | 8/2002 | Kochanski et al. | |
| 2002/0143543 | A1 | 10/2002 | Sirivara | |
| 2002/0173961 | A1 * | 11/2002 | Guerra | G10L 13/08 704/258 |
| 2004/0006471 | A1 * | 1/2004 | Chiu | H04M 3/4938 704/260 |
| 2004/0186713 | A1 | 9/2004 | Gomas et al. | |
| 2004/0215460 | A1 | 10/2004 | Cosatto et al. | |
| 2005/0114137 | A1 | 5/2005 | Saito et al. | |
| 2005/0125236 | A1 | 6/2005 | Agapi | |
| 2005/0182629 | A1 | 8/2005 | Coorman et al. | |
| 2005/0288932 | A1 * | 12/2005 | Kurzweil | G06K 9/00993 704/260 |
| 2006/0015342 | A1 | 1/2006 | Kurzweil et al. | |
| 2006/0200355 | A1 | 9/2006 | Sideman | |
| 2007/0047719 | A1 | 3/2007 | Dhawan | |
| 2007/0112571 | A1 | 5/2007 | Thirugnana | |
| 2009/0063153 | A1 | 3/2009 | Kapilow et al. | |
| 2009/0216531 | A1 * | 8/2009 | Yanagihara | G10L 15/26 704/235 |
| 2010/0114579 | A1 | 5/2010 | Ostermann et al. | |
| 2010/0115454 | A1 * | 5/2010 | Tuli | H04L 67/04 715/780 |
| 2011/0071835 | A1 | 3/2011 | Chen et al. | |
| 2012/0065979 | A1 | 3/2012 | Wong et al. | |

OTHER PUBLICATIONS

Bigham et al, "Addressing Performance and Security in a Screen Reading Web Application That Enables Accessibility Anywhere," 2008, Eighth International Conference on Web Engineering, Yorktown Heights, NJ, 2008, pp. 273-284.*

Cosatto et al., "Lifelike talking faces for interactive services," 2003, In Proceedings of the IEEE, vol. 91, No. 9, pp. 1406-1429.

* cited by examiner

SYSTEM AND METHOD FOR LOW-LATENCY WEB-BASED TEXT-TO-SPEECH WITHOUT PLUGINS

PRIORITY INFORMATION

The present application is a continuation of U.S. patent application Ser. No. 13/308,860, filed Dec. 1, 2011, the content of which is incorporated herein by reference in its entirety.

BACKGROUND

1. Technical Field

The present disclosure relates to low latency text-to-speech and more specifically to web-based low latency text-to-speech without plugins.

2. Introduction

Current approaches for incorporating text-to-speech (TTS) functionality for web browsing or other web-based applications suffer from several limitations. For a system to be responsive, or in other words to have low latency characteristics, current approaches feed the text to be synthesized to the synthesizer in small chunks, and use Adobe® Flash® Player or some other external program or web browser plug-in to render the audio. These other programs may not always be available, especially so on mobile or other low-resource devices. Thus, the TTS system is often deprived of potentially valuable information that would be present in complete sentences or paragraphs. This information, if it were available, could be used to render the audio with appropriate prosody or other features. These approaches can provide either good latency or good prosody, but provide each at the expense of the other. In other words, current approaches for web-based TTS are unable to provide both good latency and good prosody at the same time, and rely on browser plug-ins.

SUMMARY

Additional features and advantages of the disclosure will be set forth in the description which follows, and in part will be understood from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, and non-transitory computer-readable storage media for reducing latency in web-browsing TTS systems without the use of a plug-in or Flash® module. A system configured according to this disclosure allows the browser to send prosodically meaningful sections of text to a web server. The web server in turn passes on the text to a TTS server for processing, which begins outputting audio and notifications. Upon identifying an independent intonational phrase within which the intonation does not depend on any variables outside the intonational phrase, the TTS server generates speech for the intonational phrase, which the web server caches in an audio buffer, indexed by a unique identifier associated with the input text plus an index number. Notification information can likewise be stored, although in a separate section of the file from the audio. Thus, the client can fetch audio corresponding to the first intonational phrase, which is generated with appropriate intonation, for playback while the remaining intonational phrases are being processed and stored in the cache as they become available.

As the system continues converting text into speech, when identical text appears the system uses the cached audio corresponding to the identical text without the need for re-synthesis via the TTS server. Because the audio does not need to be resynthesized, if an intonational phrase is detected which matches a previously synthesized text, the system can prepare an audio request for that text out of sequence. In addition, making the prosodically meaningful sections of text align with intonational phrases creates section boundaries in silence, such that any network delay results in a longer pause between phrases, rather than broken audio. This approach can provide a more natural sounding output, because the pauses occur in appropriate locations, i.e. between sentences or clauses, and not mid-word.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The present disclosure addresses the need in the art for text-to-speech conversion in web browsing. A system, method and non-transitory computer-readable media are disclosed which reduce latency in web-browsing TTS systems without the use of a plug-in or Flash® module. A brief introductory description of a basic general purpose system or computing device in FIG. 1 which can be employed to practice the concepts is disclosed herein. A more detailed description, accompanied by various embodiments and variations, will then follow. The disclosure now turns to FIG. 1.

Figure 1:
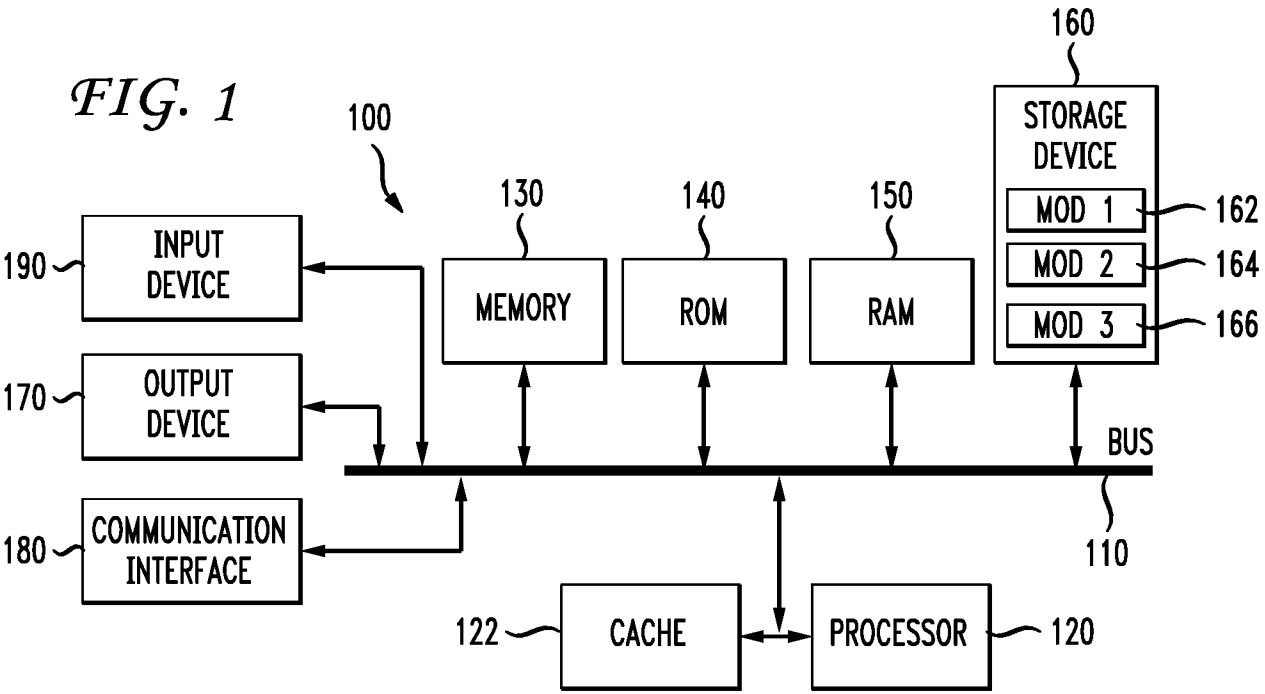
FIG. 1 illustrates an example system embodiment.

With reference to FIG. 1, an exemplary system 100 includes a general-purpose computing device 100, including a processing unit (CPU or processor) 120 and a system bus 110 that couples various system components including the system memory 130 such as read only memory (ROM) 140 and random access memory (RAM) 150 to the processor 120. The system 100 can include a cache 122 of high speed memory connected directly with, in close proximity to, or integrated as part of the processor 120. The system 100 copies data from the memory 130 and/or the storage device 160 to the cache 122 for quick access by the processor 120. In this way, the cache provides a performance boost that avoids processor 120 delays while waiting for data. These and other modules can control or be configured to control the processor 120 to perform various actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output system (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. The storage device 160 is connected to the system bus 110 by a drive interface. The drives and the associated computer readable storage media provide non-volatile storage of computer readable instructions, data structures, program modules and other data for the computing device 100. In one aspect, a hardware module that performs a particular function includes the software component stored in a non-transitory computer-readable medium in connection with the necessary hardware components, such as the processor 120, bus 110, display 170, and so forth, to carry out the function. The basic components are known to those of skill in the art and appropriate variations are contemplated depending on the type of device, such as whether the device 100 is a small, handheld computing device, a desktop computer, or a computer server.

Although the exemplary embodiment described herein employs the hard disk 160, it should be appreciated by those skilled in the art that other types of computer readable media which can store data that are accessible by a computer, such as magnetic cassettes, flash memory cards, digital versatile disks, cartridges, random access memories (RAMs) 150, read only memory (ROM) 140, a cable or wireless signal containing a bit stream and the like, may also be used in the exemplary operating environment. Non-transitory computer-readable storage media expressly exclude media such as energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations discussed below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited non-transitory computer-readable storage media. Such logical operations can be implemented as modules configured to control the processor 120 to perform particular functions according to the programming of the module. For example, FIG. 1 illustrates three modules Mod 1 162, Mod 2 164 and Mod 3 166 which are modules configured to control the processor 120. These modules may be stored on the storage device 160 and loaded into RAM 150 or memory 130 at runtime or may be stored as would be known in the art in other computer-readable memory locations.

Figure 2:
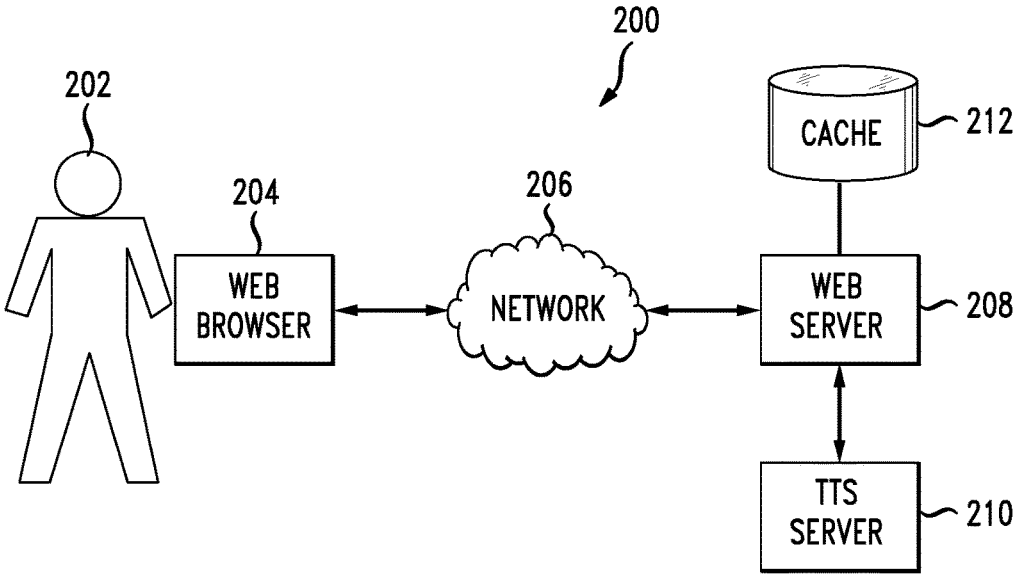
FIG. 2 illustrates an example web-based text-to-speech architecture.

Having disclosed some components of a computing system, the disclosure now returns to a discussion of web-browser based speech synthesis using intonational phrases. FIG. 2 illustrates an exemplary web-based text-to-speech architecture 200. The architecture 200 illustrates a user 202 utilizing a web browser 204 which interacts with a web server 208. This interaction takes place through a network 206, such as the Internet, a telephone network, a radio network, or an internal network (Intranet). The user 202 can interact with the web browser 204 through a computing device, a smartphone, a computer terminal. As the user 202 uses the web browser 204 to interact with webpages and other documents, that information can be converted to text using the illustrated architecture 200. In one example, the user explicitly enters text into a text field or selects text on a web page for speech synthesis. This approach can be automated, such as a custom web browser 204 for visually impaired users that reads the text, metadata, and/or other information associated with a web page aloud to the user.

The web browser 204, web server 208, and/or the TTS server 210 can detect prosodically meaningful segments of text. For example, the web browser 204 can transmit those segments over the network 206 to the web server 208 which analyzes the text. If the text has not been previously synthesized, the text is converted to audio in the TTS server 210. This audio is then saved in the cache 212 as well as transmitted back to the user 202. If the text has been previously synthesized, the web server 208 instead requests the previously synthesized audio from the cache 212.

As another example, the web server 208 can receive text from the web browser 204 and identify intonational phrases in the text. The web server 208 passes the intonational phrases to the TTS server 210 for speech synthesis. The web server 208 receives the synthesized speech from the TTS server 210 and stores it in the cache 212, and can optionally notify the web browser 204 that the intonational phrase is available. In another example, the web browser 204 submits text to the web server 208 for speech synthesis. The web server 208 passes the text to the TTS server 210 which parses the text to identify the intonational phrases, and performs text-to-speech synthesis on the first intonational phrase and stores the synthesized speech in the cache 212.

As illustrated, the web server 208, the cache 212, and the TTS server 210 are all separate components. However, in certain configurations any of the web server 208, the cache 212, and the TTS server 210 can be combined together, such that the web server 208 contains the cache 212, a TTS module 210, or both 210, 212. In other configurations, the cache 212 and the TTS server 210 are a combined component, with the web server 208 being separate. In such a configuration, the web server 208 functions to prepare the requests to the combined TTS server/cache 210, 212. In any configuration, whether a combination or separated, the text sent to the TTS server 210 is communicated out in manageable, prosodically significant pieces.

Intonational phrases define prosodically significant segments of audio, and can include sentences, clauses, and in certain instances, individual words. The system can identify intonational phrases based on punctuation marks, such as periods, exclamation marks, question marks, and commas, for example. Because text can contain multiple intonational phrases, the system can change the size of text sent to the TTS server 210 or audio portions identified by the TTS server 210. For example, if a system is configured to process paragraph sized text, which will in turn be converted to audio by the TTS server 210 and stored in the cache 212, then the paragraph sized text will also contain within it sentence sized text. If the system detects network traffic or delays, or the data indicates that latency is too high to convert full paragraphs, the system can change the size of audio files produced to sentences from paragraphs, thereby reducing latency. Similarly, the system can change from small audio transfers (e.g. sentences) to large audio transfers (e.g. paragraphs) if the system detects that such a change is desirable. In an alternate configuration, the system does not consider size at all when identifying intonationally independent phrases, and determines boundaries for intonational phrases based on text having self-contained intonation cues that do not depend or rely on information outside of that intonational phrase.

Figure 3:
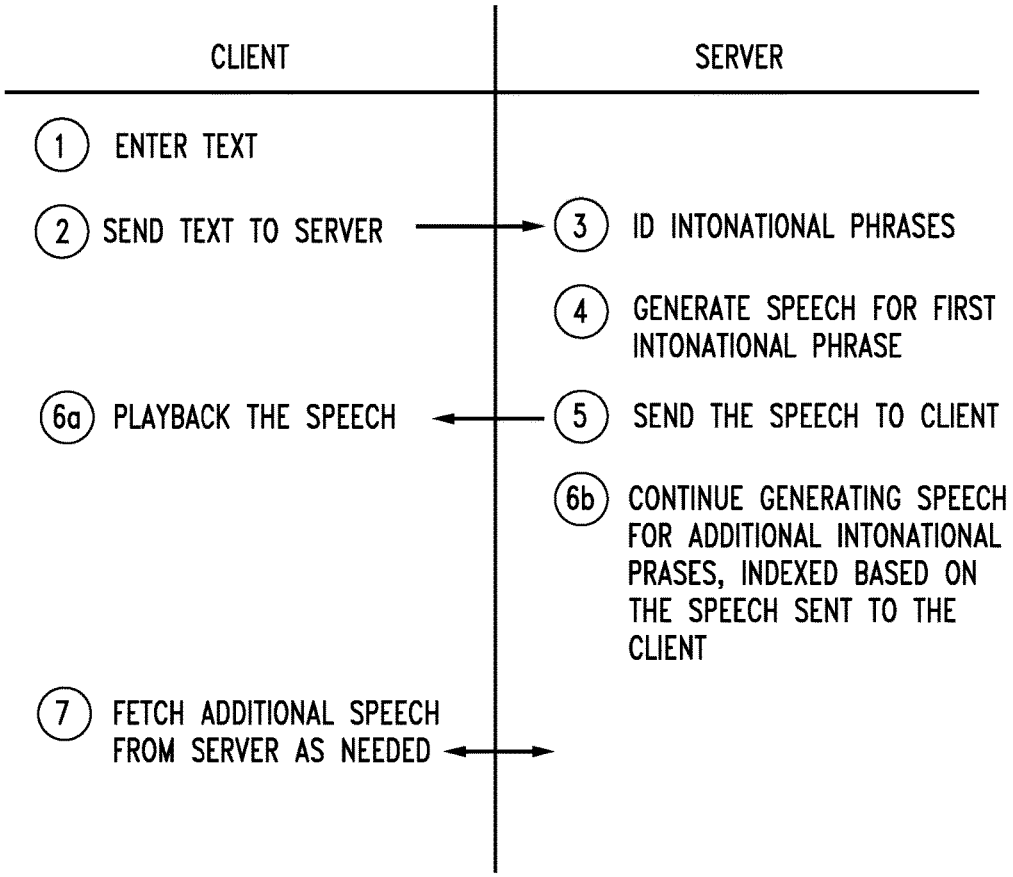
FIG. 3 illustrates an example set of client and server interactions.

FIG. 3 illustrates an example set of client and server interactions. The client is a computing device, such as a smart phone, computer or computer terminal, or other device having a web browser. The client enters or receives text associated with a webpage (1), either automatically or upon receiving an input from a user, the webpage being accessed by the web browser. The client in turn sends text to the server (2). The client, in sending this text, can communicate the text in a compressed or uncompressed format, and depending on the network connection, can parse the text into segments to reduce latency, meet bandwidth demands, or meet other network requirements. As illustrated, the server then identifies intonational phrases within the text (3). If the text received by the server is broken into smaller segments as described above, the server can piece together text as it is received to build intonational phrases of sufficient length.

Upon identifying intonational phrases, the server generates speech for the first intonational phrase (4), which the server sends to the client (5). This speech is audibly played at the client (6*a*), while the server continues to generate speech for additional intonational phrases (6*b*). This approach can be implemented using JavaScript and XML on the web browser side that communicates with the server via AJAX style calls without any browser plug-ins or other software modules external to the browser. In generating speech for additional intonational phrases (6*b*), the server checks to see if any of the previously synthesized text matches the intonational phrases found in the text awaiting synthesis. These previously synthesized intonational phrases are indexed according to the specifics of the text, such that the server can easily locate them upon finding additional, identical text. As the user uses the web browser, the client continues to fetch additional speech from the server as needed (7). In certain cases, this additional request comes because the user has accessed a new web page, whereas in other cases the user has scrolled to another part of the page, is focusing on a specific part of the page, or the page has become modified and requires a new TTS conversion. In situations where modifications occur to the webpage, determining if the page has become sufficiently modified that it requires a new TTS conversion can be done by comparing the updated text to the previous text, and if the differences surpass a threshold value performing the TTS conversion a second time. For example, if the webpage text changed from "their" to "there," the threshold might not be met. However, if the text changed from "their" to "three," the threshold might be met. In other cases, every change to the webpage prompts synthesis of the text if the new text has not been previously cached.

Figure 4:
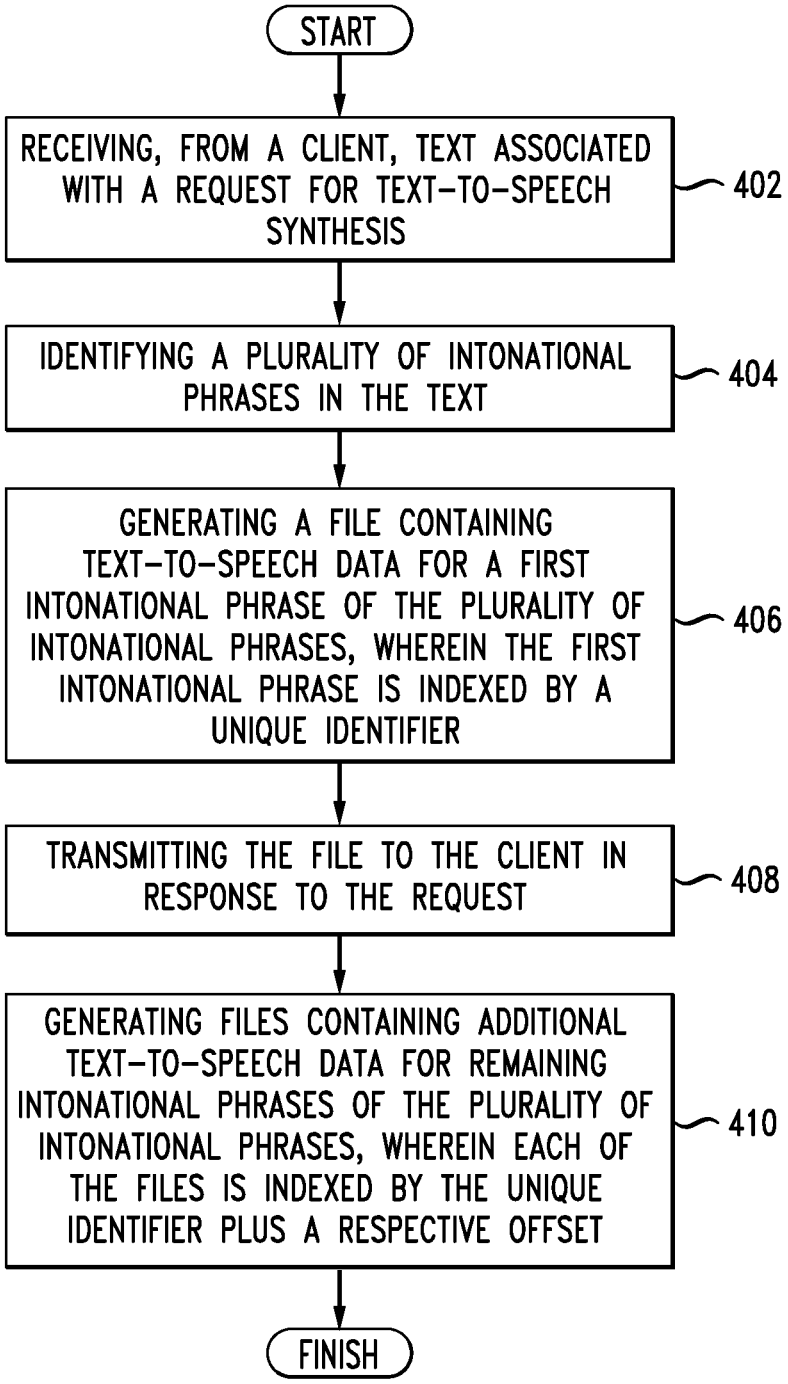
FIG. 4 illustrates an example method embodiment.

Having disclosed some basic system components and concepts, the disclosure now turns to the exemplary method embodiment shown in FIG. 4. For the sake of clarity, the method is discussed in terms of an exemplary system 100 as shown in FIG. 1 configured to practice the method. The steps outlined herein are exemplary and can be implemented in any combination thereof, including combinations that exclude, add, or modify certain steps.

The system 100 receives, from a client, text associated with a request for text-to-speech synthesis (402). The system 100 then identifies a set of intonational phrases in the text (404) and generates a file containing text-to-speech data for a first intonational phrase of the set of intonational phrases, wherein the first intonational phrase is indexed by a unique identifier (406). The intonational phrase can be a phrase in which intonation within the phrase only depends on text inside of the phrase. The unique identifier used to index the first intonational phrase can be a text identifier, an offset index, or both the text identifier and offset index together.

This unique identifier can further be used to index the file associated with the intonational phrase.

The file generated, in addition to text-to-speech data, can also contain notification information, which the system 100 can use to synchronize the synthesized audio to a visualization of the text. For example, if performing the text-to-speech conversion for a child's book, the system 100 could use the notification information to display a bouncing ball alongside displayed syllables of the synthesized text as it plays. For adults, the notification information could correspond to a virtual news anchor's facial expressions, a mouth on a virtual reader, or other virtual persona mouthing the words as they play. Depending on the particular situation, the system 100 can generate parallel versions of the file and the files using different text-to-speech voices. For instance, if different users have voice preferences then the system 100 can use those preferences to generate the files and eliminate the need to resynthesize those files in the future. In other instances if the text contains a transcription of a real occurrence there can exist a conversation between multiple people recorded. In such situations it can improve the comprehension and quality of the audible playback if there exist different voices within the speech files.

The system 100, after generating the file, then transmits the file to the client in response to the request (408), and generates files containing additional text-to-speech data for remaining intonational phrases of the set of intonational phrases, wherein the system indexes each of the files by the unique identifier plus a respective offset (410). The system 100 can continue storing these files indefinitely, creating an index for recognized intonational phrases and greatly increasing future TTS occurrences. Alternatively, the system 100 can delete the cache daily, upon powering down, upon receiving input from the user directing the deletion of the files, and/or upon an expiration threshold. One example of an expiration threshold is an absolute time value, such as 2 hours from creation. Another example of an expiration threshold is based on the frequency and recency of access to a particular cache entry. Another configuration allows the system 100 to determine which of the files the system considers as unlikely in future text-to-speech instances. The system can then delete those files, or present the files to a user, on the client side and/or the server side, for confirmation prior to deletion.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. For example, the principles herein equally to text-to-speech used for the visually impaired, child education, and as a tool when one's attention is focused elsewhere. Those skilled in the art will readily recognize various modifications and changes that may be made to the principles described herein without following the example embodiments and applications illustrated and described herein, and without departing from the spirit and scope of the disclosure.

We claim:

1. A method comprising:

receiving, at a computing device and from a client and over a network, text associated with a request for text-to-speech synthesis;

determining a network latency caused by the network for the text received from the client to yield a determination, wherein the network latency indicates a delay in receiving the text over the network;

performing, via a processor of the computing device, an analysis of an amount of the text to identify a plurality of intonational phrases in the text, wherein the amount of the text being analyzed and received from the client is chosen based on the network latency;

generating, via the processor, a first file containing text-to-speech data for a first intonational phrase of the plurality of intonational phrases using a first text-to-speech voice;

transmitting the first file to the client in response to the request; and while the client plays the first file, generating, via the processor, a second file containing the text-to-speech data for a second intonational phrase of the plurality of intonational phrases using a second text-to-speech voice.

2. The method of claim 1, wherein an intonational phrase is a phrase in which intonation within the phrase only depends on text inside the phrase.

3. The method of claim 1, wherein the first intonational phrase is indexed by a first identifier, wherein the second intonational phrase is indexed by a second identifier, and wherein one of the first identifier is a first unique identifier and the second identifier is a second unique identifier.

4. The method of claim 1, wherein the first file contains notification information.

5. The method of claim 4, wherein the notification information comprises synchronization data.

6. The method of claim 3, wherein the first unique identifier and the second unique identifier each comprises a text identifier and an offset index.

7. The method of claim 1, wherein the second file contains additional notification information.

8. The method of claim 1, wherein generating the second file occurs while an application plays the text-to-speech data in the first file.

9. The method of claim 1, wherein the receiving and the transmitting occur on a web server, wherein the web server deletes items saved in a cache within an expiration threshold.

10. The method of claim 1, further comprising transmitting one of the first file and the second file to an application in response to an additional request.

11. The method of claim 1, wherein boundaries between intonational phrases comprise silence.

12. The method of claim 1, further comprising:

receiving text-to-speech settings from the client; and generating the first file and the second file according to the text-to-speech settings.

13. The method of claim 1, further comprising:

generating parallel versions of the first file and the second file using different text-to-speech voices.

14. A system comprising:

a processor; and a computer-readable storage medium having instructions stored which, when executed by the processor, cause the processor to perform operations comprising:

receiving, from a client and over a network, text associated with a request for text-to-speech synthesis;

determining a network latency caused by the network for the text received from the client to yield a determination, wherein the network latency indicates a delay in receiving the text over the network;

performing an analysis of an amount of the text to identify a plurality of intonational phrases in the text, wherein the amount of the text being analyzed and received from the client is chosen based on the network latency;

generating a first file containing text-to-speech data for a first intonational phrase of the plurality of intonational phrases using a first text-to-speech voice;

transmitting the first file to the client in response to the request; and while the client plays the first file, generating a second file containing the text-to-speech data for a second intonational phrase of the plurality of intonational phrases using a second text-to-speech voice.

15. The system of claim 14, wherein an intonational phrase is a phrase in which intonation within the phrase only depends on text inside the phrase.

16. The system of claim 14, wherein the first intonational phrase is indexed by a first identifier, wherein the second intonational phrase is indexed by a second identifier, and wherein one of the first identifier is a first unique identifier and the second identifier is a second unique identifier.

17. The system of claim 14, wherein the first file contains notification information.

18. The system of claim 17, wherein the notification information comprises synchronization data.

19. The system of claim 16, wherein the first unique identifier and the second unique identifier each comprises a text identifier and an offset index.

20. A computer-readable storage device having instructions stored which, when executed by a computing device, cause the computing device to perform operations comprising:

receiving, at the computing device and from a client and over a network, text associated with a request for text-to-speech synthesis;

determining a network latency caused by the network for the text received from the client to yield a determination, wherein the network latency indicates a delay in receiving the text over the network;

performing an analysis of an amount of the text to identify a plurality of intonational phrases in the text, wherein the amount of the text being analyzed and received from the client is chosen based on the network latency;

generating a first file containing text-to-speech data for a first intonational phrase of the plurality of intonational phrases using a first text-to-speech voice;

transmitting the first file to the client in response to the request; and while the client plays the first file, generating a second file containing the text-to-speech data for a second intonational phrase of the plurality of intonational phrases using a second text-to-speech voice.

* * * * *